US008740693B2

(12) United States Patent
Gomez et al.

(10) Patent No.: US 8,740,693 B2
(45) Date of Patent: Jun. 3, 2014

(54) GAMING SYSTEMS HAVING MULTI-OUTPUT DISPLAYS

(75) Inventors: Benjamin T. Gomez, Chicago, IL (US); Jeremy M. Hornik, Chicago, IL (US); Joel R. Jaffe, Glenview, IL (US); Alfred Thomas, Las Vegas, NV (US); Muthu Velu, Addison, IL (US)

(73) Assignee: WMS Gaming Inc., Waukegan, IL (US)

( * ) Notice: Subject to any disclaimer, the term of this patent is extended or adjusted under 35 U.S.C. 154(b) by 1339 days.

(21) Appl. No.: 12/525,531

(22) PCT Filed: Feb. 1, 2008

(86) PCT No.: PCT/US2008/001359

§ 371 (c)(1),
(2), (4) Date: Aug. 22, 2011

(87) PCT Pub. No.: WO2008/097469

PCT Pub. Date: Aug. 14, 2008

(65) Prior Publication Data

US 2012/0028701 A1 Feb. 2, 2012

Related U.S. Application Data

(60) Provisional application No. 60/899,160, filed on Feb. 2, 2007.

(51) Int. Cl.
*A63F 9/24* (2006.01)

(52) U.S. Cl.
USPC ..... 463/25; 463/2; 463/31

(58) Field of Classification Search
USPC ..... 463/25, 2, 31
See application file for complete search history.

(56) References Cited

U.S. PATENT DOCUMENTS

| | | | |
|---|---|---|---|
| 5,877,829 | A | 3/1999 | Okamoto et al. |
| 6,724,450 | B1 | 4/2004 | Knoll et al. |
| 8,144,079 | B2 | 3/2012 | Mather et al. |
| 8,149,272 | B2 | 4/2012 | Evans et al. |
| 8,154,800 | B2 | 4/2012 | Kean et al. |

(Continued)

FOREIGN PATENT DOCUMENTS

| | | |
|---|---|---|
| EP | 0822441 | 2/1998 |
| EP | 0829744 | 3/1998 |

(Continued)

OTHER PUBLICATIONS

International Search Report—International Application No. PCT/US2008/001359; Filed Jan. 2, 2008—Dated: Aug. 26, 2008 (5 pages).

*Primary Examiner* — Pierre E Elisca
(74) *Attorney, Agent, or Firm* — Nixon Peabody LLP

(57) ABSTRACT

A gaming system comprises a wager input device and a housing. The gaming system further comprises a multi-output display supported by the housing, the multi-output display displaying a first video presentation viewable from a first position having a first viewing angle relative to the display. The multi-output display displays a second video presentation viewable from a second position having a second viewing angle relative to the display, wherein the second video presentation is not viewable from the first position. At least one of the first and second video presentations includes displaying a randomly selected outcome of a wagering game. The gaming system further comprises a controller operative to simultaneously generate the first and second video presentations on the multi-output display.

20 Claims, 8 Drawing Sheets

(56) References Cited

U.S. PATENT DOCUMENTS

| | | | | |
|---|---|---|---|---|
| 8,289,458 | B2 | 10/2012 | Walton et al. | |
| 8,314,918 | B2 | 11/2012 | Kean et al. | |
| 2003/0048389 | A1 | 3/2003 | Alden | |
| 2005/0059487 | A1 | 3/2005 | Wilder et al. | |
| 2007/0058127 | A1 | 3/2007 | Mather et al. | |
| 2007/0058258 | A1 | 3/2007 | Mather et al. | |
| 2008/0204871 | A1 | 8/2008 | Mather et al. | |
| 2009/0080099 | A1 | 3/2009 | Tanimoto et al. | |
| 2009/0086150 | A1 | 4/2009 | Koyama et al. | |
| 2009/0102990 | A1 | 4/2009 | Walton et al. | |
| 2009/0191965 | A1 * | 7/2009 | Dixon | 463/31 |
| 2010/0149136 | A1 | 6/2010 | Fukushima et al. | |
| 2012/0220363 | A1 * | 8/2012 | Bytnar et al. | 463/25 |
| 2012/0225711 | A1 * | 9/2012 | Dixon | 463/25 |
| 2013/0084965 | A1 * | 4/2013 | Gura et al. | 463/26 |
| 2014/0011561 | A1 * | 1/2014 | Lutnick et al. | 463/17 |

FOREIGN PATENT DOCUMENTS

| | | | |
|---|---|---|---|
| EP | 1427223 | | 6/2004 |
| EP | 1785941 | | 5/2007 |
| EP | 1903541 | | 3/2008 |
| EP | 1919219 | | 5/2008 |
| EP | 2023188 | | 2/2009 |
| GB | 2405519 | A | 3/2005 |
| JP | 2002-248226 | A | 9/2002 |
| JP | 2007-222327 | A | 9/2007 |
| JP | 2007-222331 | A | 9/2007 |
| JP | 2007-222334 | A | 9/2007 |
| WO | WO 2008/032474 | A1 | 3/2008 |

* cited by examiner

GAMING SYSTEMS HAVING MULTI-OUTPUT DISPLAYS

CROSS REFERENCE TO RELATED APPLICATIONS

This application is a U.S. national stage filing of International Application No. PCT/US2008/001359, filed Feb. 1, 2008, which is related to and claims priority from U.S. Provisional Application No. 60/899,160, filed Feb. 2, 2007 which are both incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to gaming systems having multi-output displays with video output signals dependent upon viewing angle.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming systems with new types of bonus games to satisfy the demands of players and operators.

Traditionally, gaming machines utilize one or more video displays to output the presentation of wagering games. Such traditional displays include CRT, LCD, LED, plasma, and other varieties of video displays. One problem with such traditional displays is that the output is limited to one video presentation per display. Another problem is that the use of multiple displays to overcome such limitations adds significant and sometimes prohibitive cost to the gaming machine as compared to the relative cost of other gaming machines. Yet another problem is that the power usage and dissipation of such multiple displays within a gaming machine is higher, causing operational and maintenance costs to increase. The present invention is directed to solving these and other problems.

SUMMARY OF THE INVENTION

According to one aspect of the present invention, a gaming system comprises a wager input device and a housing. The gaming system further comprises a multi-output display supported by the housing, the multi-output display displaying a first video presentation viewable from a first position having a first viewing angle relative to the display. The multi-output display displays a second video presentation viewable from a second position having a second viewing angle relative to the display, wherein the second video presentation is not viewable from the first position. At least one of the first and second video presentations includes displaying a randomly selected outcome of a wagering game. The gaming system further comprises a controller operative to simultaneously generate the first and second video presentations on the multi-output display.

According to yet another aspect of the invention, a method of conducting a wagering game on a gaming system comprises receiving a wager and simultaneously displaying a first video presentation and a second video presentation on a multi-output display. The first video presentation is viewable from a first position having a first viewing angle relative to the display. The second video presentation is viewable from a second position having a second viewing angle relative to the display. At least one of the first and second video presentations includes displaying a randomly selected outcome of a wagering game.

According to another aspect of the invention, a gaming system comprises at least one wager input device, at least one housing and first and second multi-Output displays supported adjacent one another by the at least one housing. The first multi-output display displays a first video presentation viewable from a first position in front of the first multi-output display. The first multi-output display displays a second video presentation viewable from a second position in front of the second multi-output display and at an acute viewing angle to the first multi-output display. The second multi-output display displays a third video presentation viewable from the second position, wherein at least one of the second and third video presentations includes displaying a randomly selected outcome of a wagering game. The gaming system further comprises a controller operative to simultaneously generate the second and third video presentations on the first and second multi-output displays.

According to yet another aspect of the invention, a gaming system comprises at least one wager input device and a first multi-output display supported by a first gaming machine. The system further comprises a second multi-output display supported by a second gaming machine and a third multi-output display supported by a third gaming machine. The system further comprises at least one controller operative to simultaneously generate a first video presentation on the first multi-output display, a second video presentation on the second multi-output display and a third video presentation on the third multi-output display, wherein the first, second and third video presentations are received at a first position associated with the first gaming machine.

According to yet another aspect of the invention, a computer readable storage medium is encoded with instructions for directing a gaming system to perform the above method.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
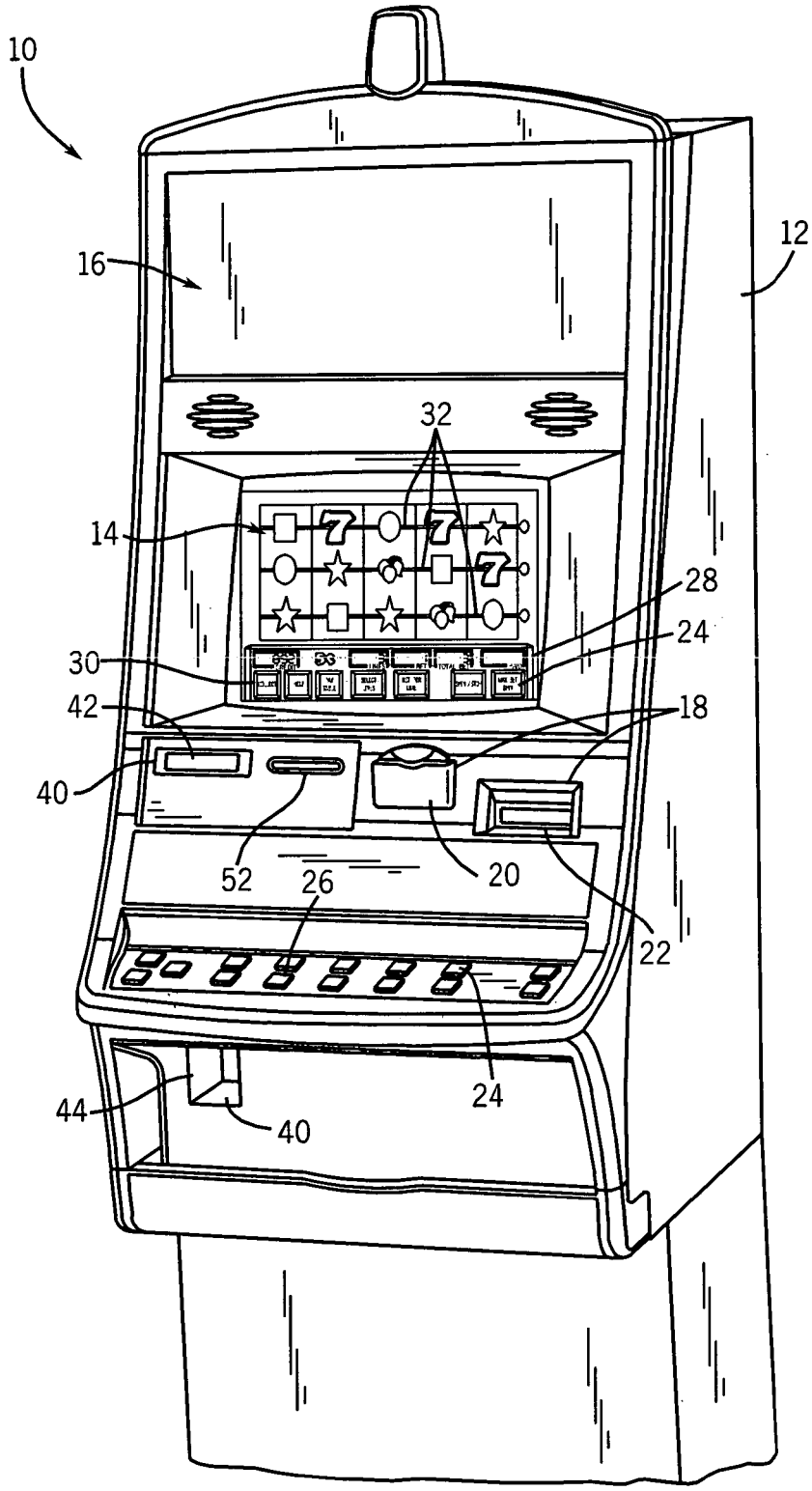
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
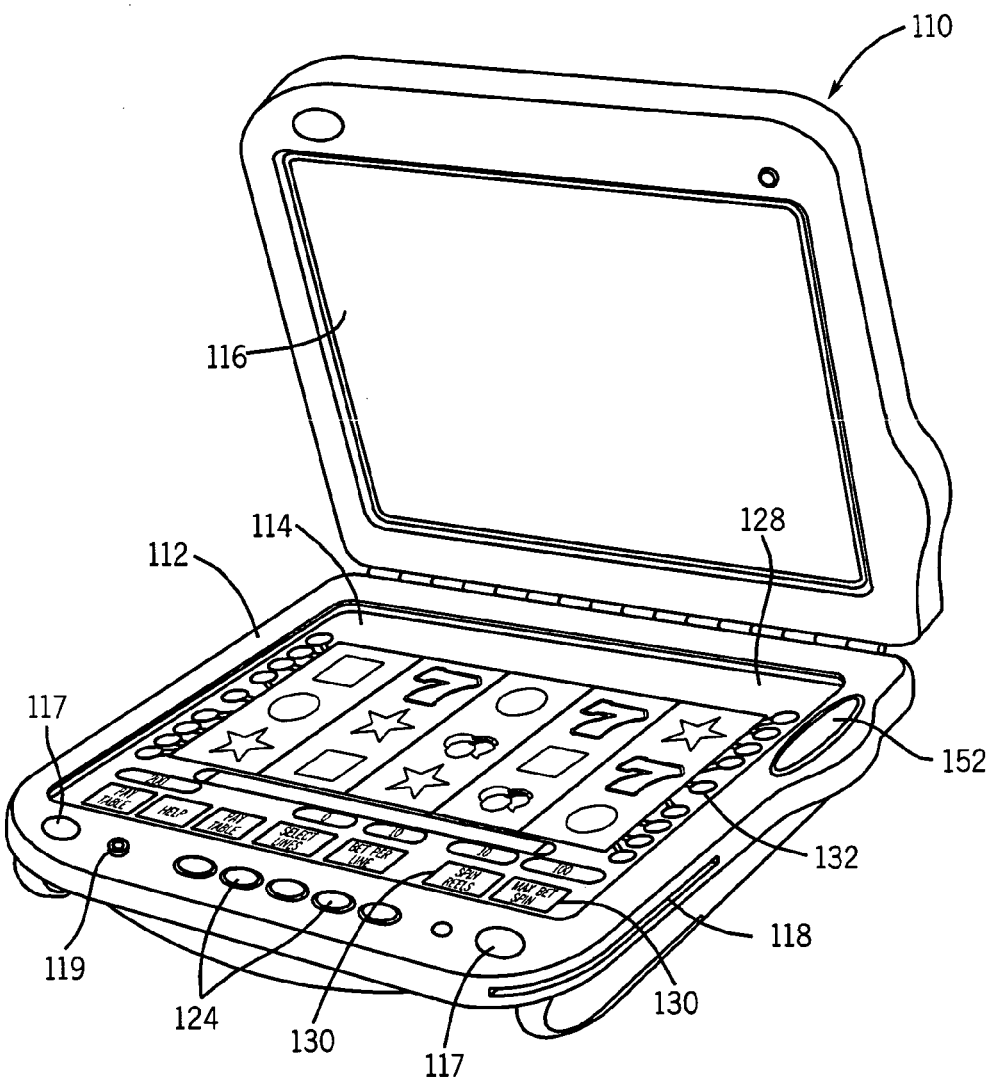
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen mounted to a primary display 114 and/or secondary display 116. In one aspect, the touch screen is matched to a display screen having one or more selectable touch keys 130 selectable by a user's touching of the associated area of the screen using a finger or a tool, such as a stylus pointer. A player enables a desired function either by touching the touch screen at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
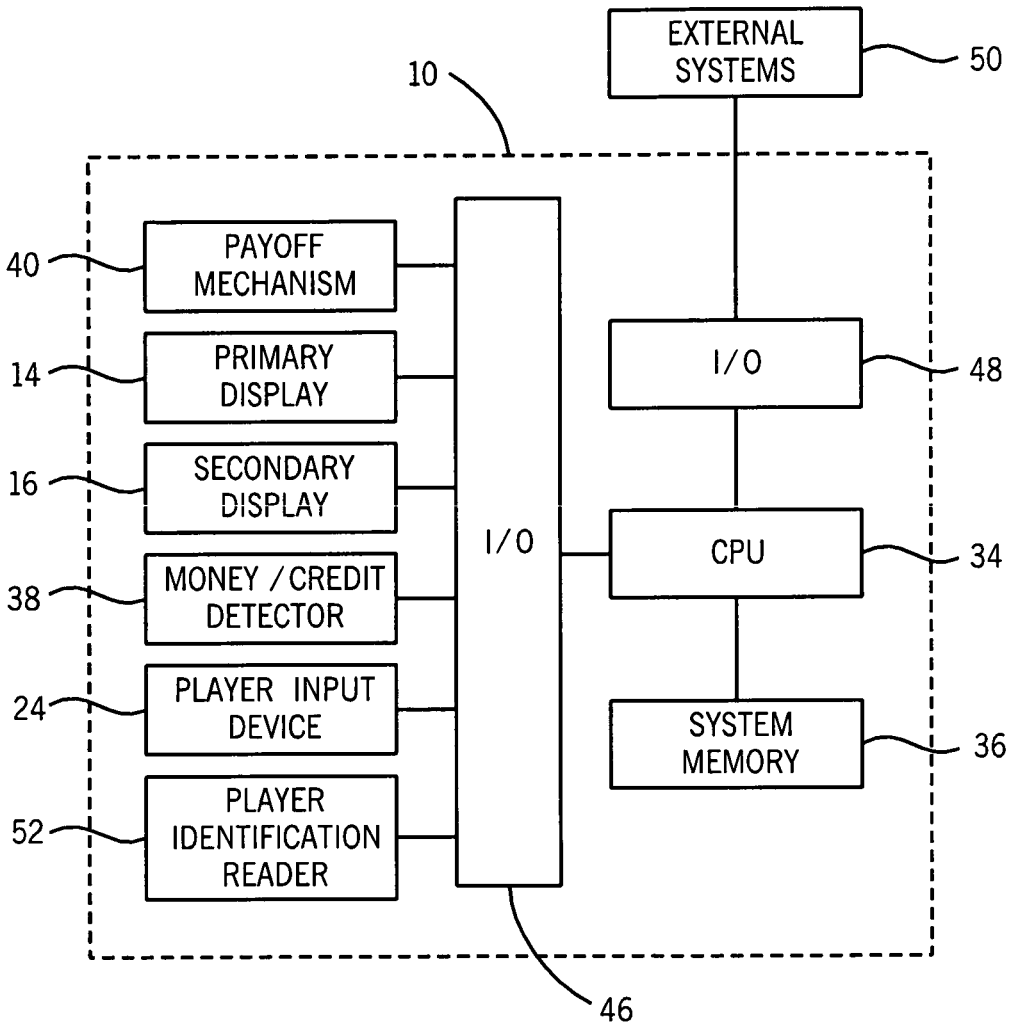
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
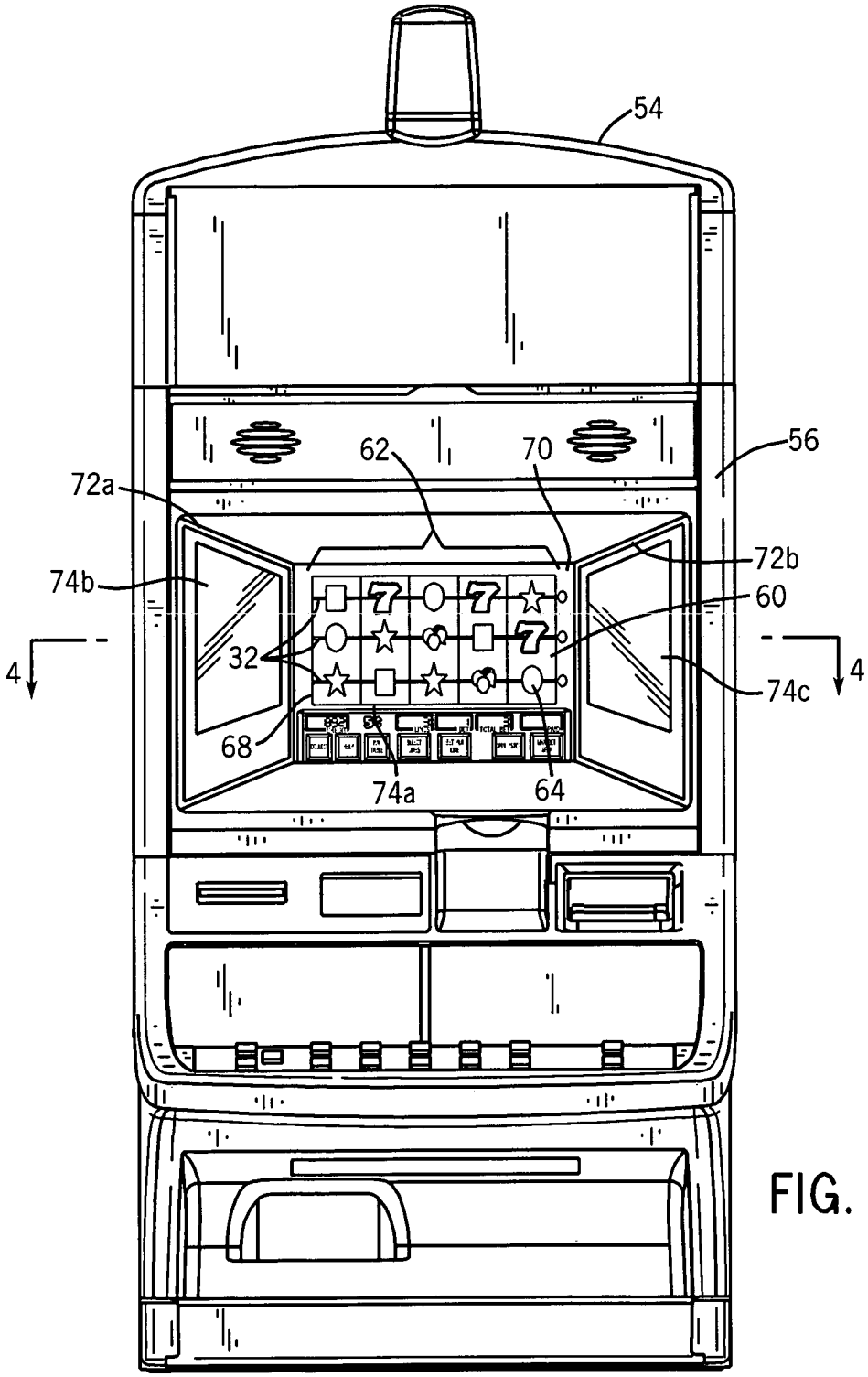
FIG. 3 is front view of a gaming system having a multi-output display.

Turning now to FIG. 3, a gaming system 54 according to one embodiment of the present invention is depicted having an improved multi-output display 70 capable of producing multiple video presentations dependent upon viewing angle of the observer. The multi-output display 70 is mounted to and supported by a housing 56 of the gaming system 54, and configured so as to produce one or more video presentations representing the play and outcome of a wagering game 60 played on the system 54. In this embodiment, the wagering game 60 is a slot game 60. The slot game 60 includes a plurality of reels 62, which in this embodiment are video simulations depicted on the multi-output display 70. The reels 62 include a plurality of symbols 64 displayed thereon. One or more paylines 32 pass through and extend across the reels 62. As described herein the symbols 64 landing on the active paylines 32 (the paylines for which a wager has been received) are evaluated for winning combinations. If a winning combination of symbols 64 lands on an active payline 32, a primary award is awarded in accordance with a paytable of the gaming device. In this embodiment, the symbols 64 are arranged in a matrix 68 of fifteen symbols 64 comprising three rows and five columns of symbols 64.

In the embodiment depicted in FIG. 3, the multi-output display 70 is positioned facing a front side of the housing 56 of the gaming system 54. The display 70 is recessed within the housing 56. Surrounding the display 70 are a plurality of mirrors 72*a,b*. In an embodiment, the mirrors 72*a,b*, are positioned on the left and right sides of the display 70 at angles. However, in alternate embodiments, the mirrors 72*a,b* may be positioned above the display 70, below the display 70, or otherwise proximate the display 70. The multi-output display 70 produces a plurality of video output signals 74*a,b,c* at a variety of viewing angles. In an embodiment, the display 70 produces three output signals 74*a,b,c* viewable from three different perspectives relative to the display 70. In other words, the display 70 produces three video outputs, each of which is viewable within predetermined ranges of viewing angles. In the embodiment shown in FIG. 3, a first video output 74*a* is emitted from the display 70 substantially perpendicular to the surface of the display 70, and thus the first output 74*a* is generally visible from directly in front of the display 70. A second video output 74*b* is emitted from the display 70 at an angle approximately thirty degrees (30 degrees) from the surface of the display 70 and is generally visible from the left side of the display 70. A third video output 74*c* is emitted from the display 70 at an angle approximately thirty degrees (30 degrees) from the surface of the display 70 and is generally visible from the right side of the display 70.

The gaming system 54 in FIG. 3 utilizes the mirrors 72*a,b* to redirect one or more of the video outputs 74 toward a player of the gaming system 54. Specifically, the left mirror 72*a* redirects the second output 74*b* towards a player positioned in front of the gaming system 54. Similarly, the right mirror 72*b* redirects the third output 74*c* towards a player positioned in front of the gaming system 54. Thus, the second and third video output signals 74*b,c*, although output at acute angles with respect to the display 70, are redirected so as to be visible from in front of display 70. In this way, the multi-output display 70—in conjunction with the mirrors 72—can present multiple presentations to the player using only one display 70, without using a second video display or reducing the size of the image displayed as the first video output 74*a*.

As seen in FIG. 3, the three video output signals 74*a,b,c* are distinct and independent video sources. The multi-output display 70 outputs three separate video signals on each of its three outputs 74*a,b,c*. Thus, the first signal 74*a* produces a video signal depicting the wagering game 60, which is a five reel slot game. Simultaneously, the second signal 74*b* produces an independent video signal, or video presentation, for example a bonus game having a plurality of selectable elements. Also simultaneously, the third signal 74*c* produces another independent video signal, or video presentation, for example game history information, or a pay table. In alternate embodiments, the various output signals 74*a,b,c* may be a variety of different video presentations and may include stationary graphics or dynamic video displays. The output signals 74*a,b,c* may be used to display game history information, game asset information, base game play, bonus game play, progressive jackpot information, or prize information. Moreover, in yet other alternative embodiments, the various output signals 74*a,b,c* may include entertainment video programming such as television, movies, or other broadcast videos.

Figure 4:
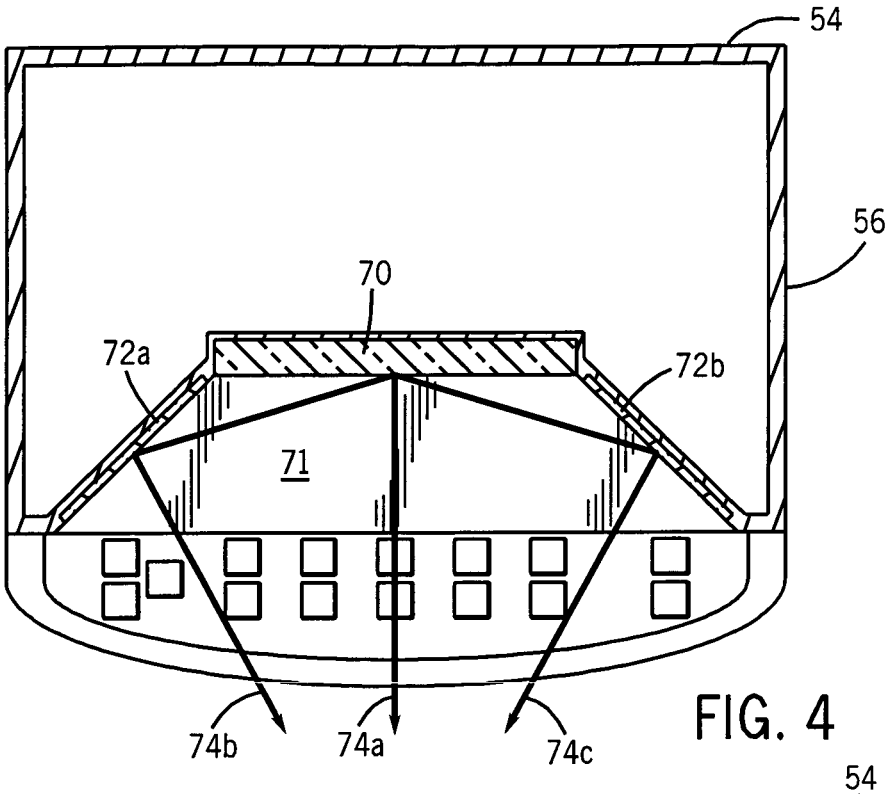
FIG. 4 is a cross-sectional view of the gaming system of FIG. 3.

Turning to FIG. 4, a cross-section of the gaming system 54 of FIG. 3 is displayed. The multi-output display 70 is depicted recessed into a cavity 71 of the housing 56 of the gaming system 54. The left and right mirrors 72*a,b* are positioned on respective sides of the cavity 71 and proximate the display 70. A first output signal 74*a* is projected directly away from the surface of the display 70 and towards a player positioned in front of the system 54. The second and third video output signals 74*b,c* are emitted at acute angles relative to the surface of the display 70, and redirected toward the player by the two mirrors 72*a,b*. Thus, as seen in FIG. 4, the multi-output display 70 produces three independent video signals 74*a,b,c* which are distinctly viewable by a player positioned in front of the gaming system 54.

Figure 5:
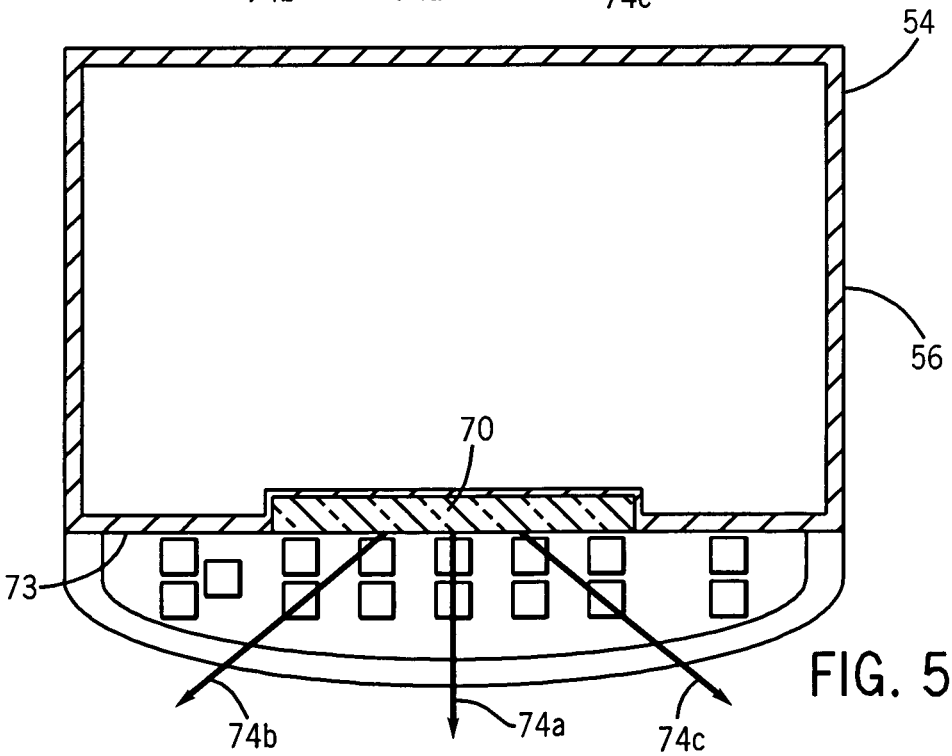
FIG. 5 is a cross-section view of an alternate embodiment of the gaming system of FIG. 3.

In FIG. 5, a top view of a cross section of an alternate embodiment of the gaming system 54 is shown. In this embodiment, the multi-output display 70 is mounted on, or proximate, a front face 73 of the housing 56. This embodiment does not utilize a cavity and mirrors. Instead, the multi-output display 70 is substantially flush mounted to the housing 56. In this embodiment, the display 70 produces three distinct video output signals 74*a,b,c*. The first output signal

74*a* is directed substantially orthogonal to the face of the display 70 and is directed outward from the gaming system 54. The second and third signals 74*b,c* are again directed to the left and right from the front of the gaming system 70, at oblique angles to the surface of the display 70. Once again, the multi-output display 70 generates three distinct and independent video signals each emitted within a predetermined viewing range of viewing angles from the front surface of the display 70. As before, the video output signals 74*a,b,c* may be any of a variety of different video output presentations. The signals 74*a,b,c* may present three different video displays or may present unified presentations over two or more of the three outputs 74*a,b,c*. However, because there are no mirrors in this embodiment, a player must physically move his head to the left or right to create an acute viewing angle with the display 70 so as to be able to view the second and third video output signals 74*b,c*.

In yet another embodiment, the multi-output display 70 may be substantially flush with the housing 56 and mirrors 72*a,b* may extend from the housing 56. In some of these embodiments, a player is able to move and adjust the mirrors 72*a,b* as he or she desires.

Figure 6:
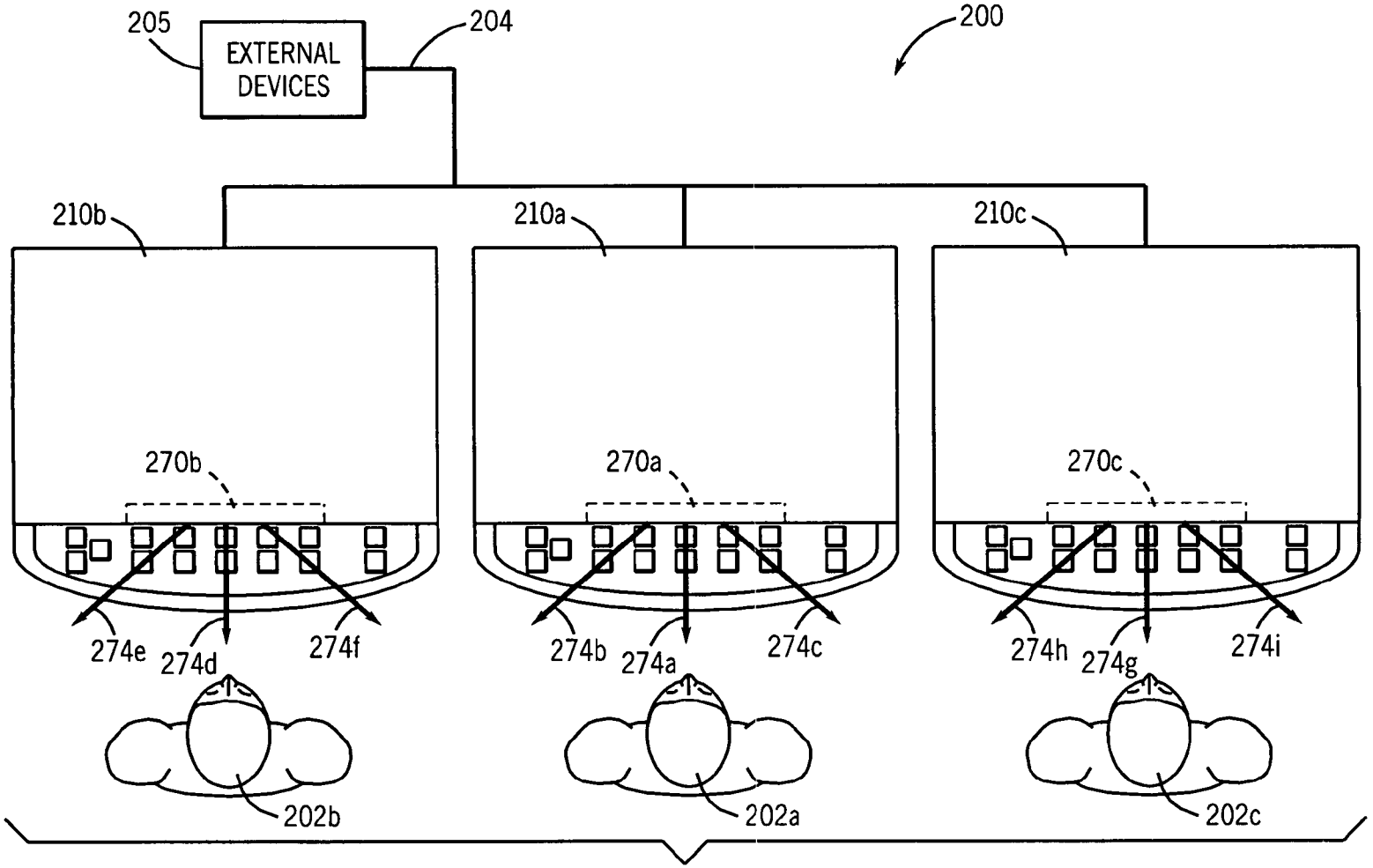
FIG. 6 is a top view of a gaming system comprising a plurality of multi-output displays.

Turning to FIG. 6, a top view of an embodiment of a gaming system 200 is displayed. In this embodiment, the system 200 comprises a plurality of gaming machines 210*a,b,c* which are positioned side by side or proximate one another. A plurality of players 202*a,b,c* are permitted to play wagering games on the plurality of machines 210*a,b,c*. Each of the gaming machines 210*a,b,c* includes a respective multi-output display 270*a,b,c* positioned substantially flush with a front side of a housing of each of the gaming machines 210*a,b,c*. As before, each of the three displays 270*a,b,c*, depicted in FIG. 6 emit a plurality of independent and distinct video output signals 274*a-i* dependent upon viewing angle relative to the display 270*a,b,c*. The first display 270*a* in the system 200 produces a first video output signal 274*a* that is generally orthogonal to the display 270*a*, and second and third output signals 274*b,c* that are generally emitted to the left and right sides of the front of the gaming machine 210*a* at oblique angles. Similarly, the second display 270*b* in the system 200 produces a first video output signal 274*d* that is generally orthogonal to the display 270*b*, and second and third output signals 274*e,f* that are generally emitted to the left and right sides of the front of the gaming machine 210*b* at oblique angles. In similar fashion, the third display 270*c* in the system 200 produces a first video output signal 274*g* that is generally orthogonal to the display 270*c*, and second and third output signals 274*h,i* that are generally emitted to the left and right sides of the front of the gaming machine 210*c* at oblique angles.

As seen in FIG. 6, the three gaming machines 210*a,b,c* of the system 200 are in communication with one another via a network 204, which as described herein, may be wired, wireless, or a combination thereof. The network 204 may also place the gaming machines 210*a,b,c* and system 200 in communication with external devices 205, which may include a variety of controllers, processors, memory, or other peripherals. The outputs 274*a-i* of the video displays 270*a,b,c*, of the system 200 are synchronized and controlled, either internally, or externally over the network, to present a coordinated set of video presentations to the one or more players 202*a,b,c* of the gaming machines 210*a,b,c*. For example, the player 202*a* seated at the middle gaming machine 210*a* (i.e., the player is located within a position associated with the first gaming machine 210*a*) is able to view three separate video signals 274*a,f,h* from the viewing angle he or she has when seated in front of the gaming machine 210*a*. More specifically, such a player 202*a* is able to see the right video output channel 274*f* from the display 270*b* on the second gaming machine 210*b*, the center video output channel 274*a* from the display 270*a* on the first gaming machine 210*a*, and the left video output channel 274*h* from the display 270*c* on the third gaming machine 210*c*. Thus, because of the arrangement of the displays 270*a,b,c*, in the system 200, the player 202*a* at the first gaming machine 210*a* enjoys three distinct video presentations 274*a,f,h*, one from each of the three displays 270*a,b,c* surrounding him or her.

Of course the gaming system 200 may include many more gaming machines 210 than the three machines 210*a,b,c* depicted in FIG. 6. A long line of gaming machines 210 arranged in a similar fashion to those in FIG. 6 would permit each player at the machines 210 to view three video output signals 274 on three displays 270, similar to the player at the center gaming machine 210*a* in FIG. 6. The players at the gaming machines 210*b,c* at the ends of such a linear configuration, would only be able to view two video output signals 274*d,b* and 274*g,c* respectively. However, to compensate for this, the gaming machines 210*b,c* on the ends of such linear configuration may be equipped with one or more mirrors, such as the gaming system 54 in FIGS. 3-4 so as to permit the end machines 210*b,c* to provide a player with three video output signals 274. In alternate embodiments, the machines 210 in the system 200 may be arranged in other patterns or configurations to maximize viewing pleasure for the players. For example, a large circle of gaming machines 210 may be created with the fronts of the gaming machines 210 facing outwardly, thereby eliminating the need for mirrors, as no gaming machines 210 would be placed "on the end" of a line, but rather the pattern of machines 210 and displays 270 would be continuous so as to allow each player to view multiple displays 270 as described herein.

Figure 7:
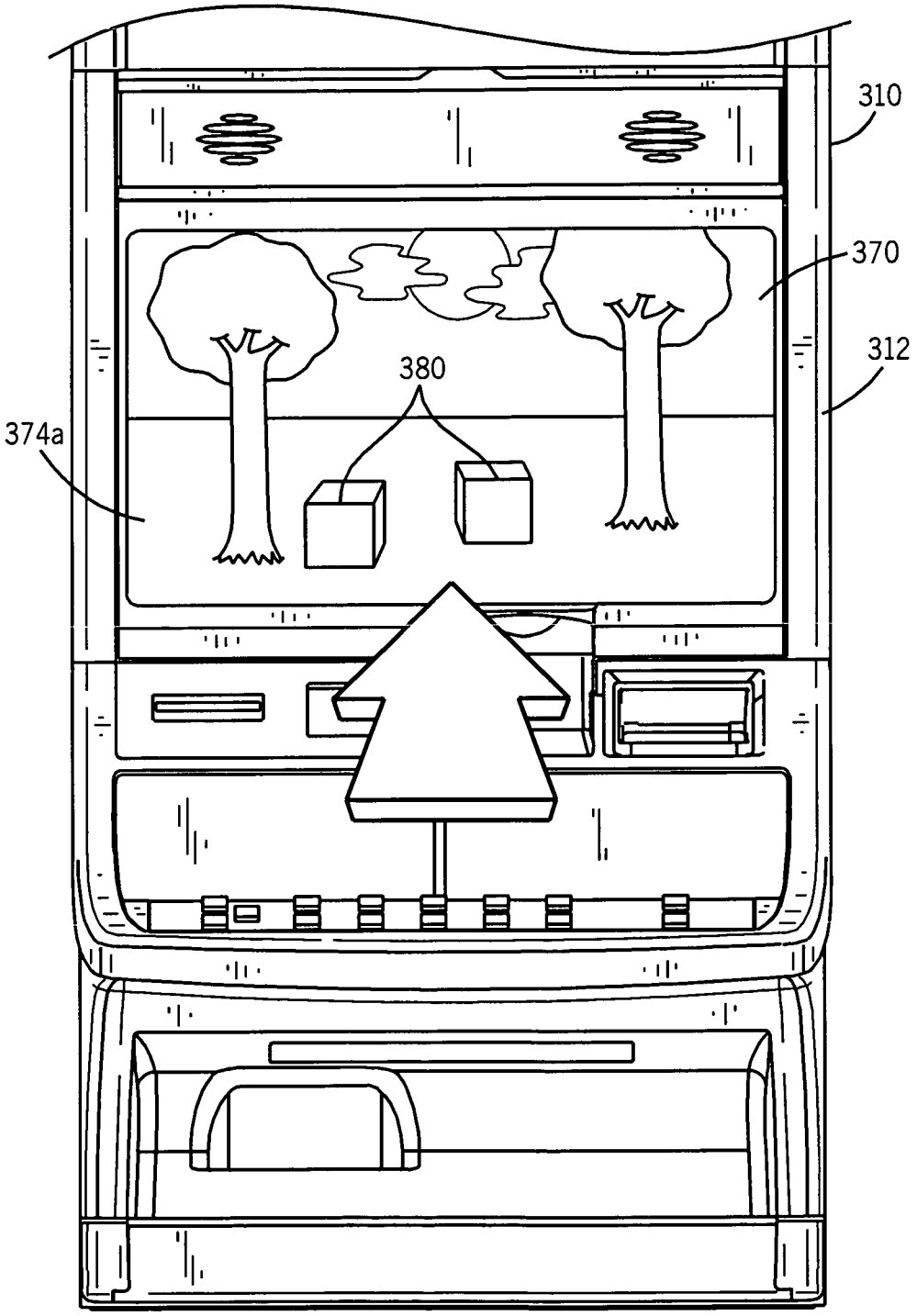
FIG. 7 is a front view of an alternate embodiment of a gaming system having a multi-output display.
Figure 8:
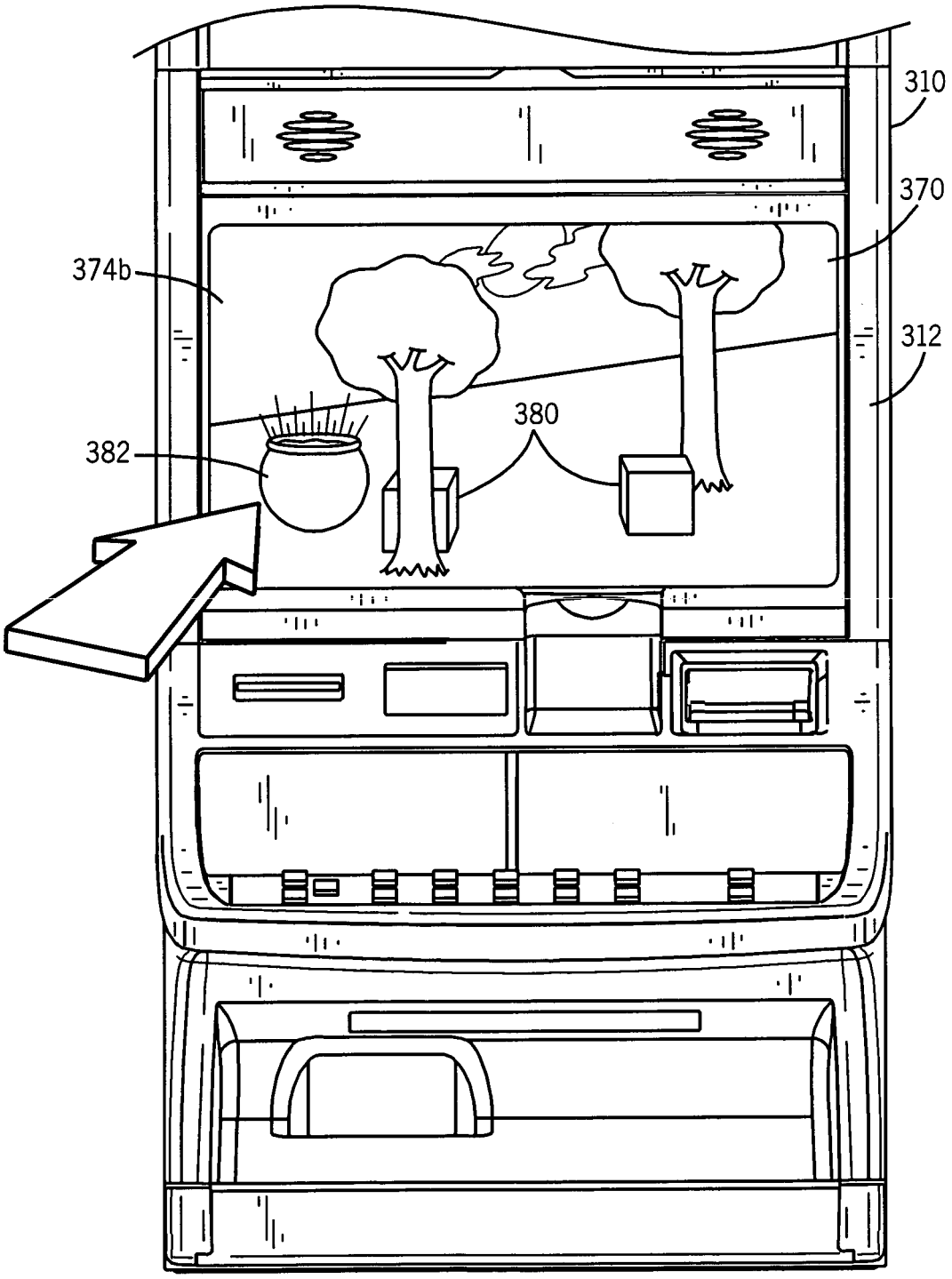
FIG. 8 is another front view of the gaming system of FIG. 7.

Turning to FIGS. 7 and 8, two front views of a gaming device 310 similar to those of FIGS. 5-6 are shown. The gaming device 310 includes a multi-output display 370 positioned substantially flush with a front side of a housing 312 of the device 310. The display 370 produces a plurality of video outputs 374 (such as video outputs 374*a,b*), which are dependent upon viewing angle relative to the surface of the display 370. In FIG. 7, a player is viewing the display 370 at an angle substantially orthogonal to the surface of the display 370, as indicated by the arrow showing the viewing angle of the player. From such viewing angle, the display 370 produces a first video output signal 374*a*, which in this embodiment, is a bonus game depicting a nature scene and including a plurality of selectable elements 380 shown as cubes or boxes. In FIG. 8, the player has leaned to his or her left to achieve a different viewing angle to the display 370. By leaning to the left, the player has changed his viewing angle to an oblique angle relative to the surface of the display 370, as indicated by the arrow showing the player's viewing angle. By changing his viewing angle, the player is no longer able to see the first video output signal 374*a* visible from the viewing angle in FIG. 7. Instead, the player is now able to see a second video output signal 374*b* which is visible from an acute viewing angle from the left side of the display 370, as indicated by the arrow. The second video output signal 374*b* presents a different view of the nature scene visible in the first video output signal 374*a* in FIG. 7. However, in the presentation of the second video output signal 374*b*, the perspective or vantage point of the nature scene has been changed such that the player is now able to see a different view of the nature scene. In this modified perspective, the player is now able to see one or more new objects not visible from the original vantage point depicted in the first output signal 374*a*. Specifically, an additional selectable item or icon 382, in this case a pot of gold icon 382, which was not visible and concealed behind one of the selectable elements 380 in the first output signal 374*a* is now visible in the second output signal 374*b* given the change in viewing angle and perspective. In this way, by changing his viewing angle relative to the display 370, the player is presented with a modified perspective view in the second video output signal 374*b*. This gives the player the illusion that by changing viewing angle (i.e., leaning to the left) the player is able to "look behind" or "see around" objects on the display 370 as if the same were performed in a real three dimensional environment. This configuration permits the multiple output signals 374 of the display 370 to be used to depict a variety of views and perspectives of a gaming environment based upon the viewing angle of the observer.

The multi-output displays 70,270,370 utilized in the embodiments shown in the FIGURES and described herein may be of varying shapes, sizes, and technologies. In one embodiment, the multi-output display 70 is an LCD display such as the Triple Directional Viewing LCD manufactured by Sharp Corporation of Osaka, Japan. In some embodiments, the multi-output display includes an imaging unit separating images of the plurality of video outputs and providing the separated images to different viewing zones (having different viewing angles) at the same time. The imaging unit may comprise: a display panel alternately displaying the images from the plurality of video outputs pixel by pixel horizontally or vertically; and a screen may be one of a parallax barrier and a lenticular lens disposed in front of the display panel and adapted to separate the images alternately displayed pixel by pixel on the display panel and transmit the separated images to different viewing zones. The screen may also be configured using another three-dimensional image technology. The display panel may be a direct-view display such as, for example, a liquid crystal display (LCD) panel, a plasma display panel, and an organic electroluminescence (EL) display or a projection type display.

In other embodiments, other configurations and technologies of multi-output displays 70 may be utilized. The multi-output display 70, as with traditional displays, comprises a matrix of pixels which output or emit light of various colors to create a video output signal. The number of pixels on the multi-output display 70 may vary from a relatively low number of pixels (or low resolution) to a relatively high number of pixels (or high resolution). The multi-output display 70 varies from traditional displays in that the pixels of the multi-output display 70 emit a plurality of distinct light signals at differing viewing angles. For example, a single pixel of the mufti-output display 70 can simultaneously generate one color of light at a first viewing angle, a second color of light at a second viewing angle, and a third color of light at a third viewing angle. In this way, each pixel of the multi-output display has multiple output channels to simultaneous generate multiple output signals. Traditional displays, such as a standard LCD display for example, emit only one light signal or channel per pixel, viewable over the entire range of viewing angles available for the display. The pixels of the multi-output display 70, having multiple channels, enable the multi-output display 70 to generate the multiple video output signals 74 over discrete ranges of viewing angles, as explained herein.

In certain embodiments, one or more of the output signals of the multi-output display may be controlled pursuant to certain eligibility rules, unlocking features, or other requirements. For example, certain gameplay information such as player statistics, history, maintenance information, etc. relative to one or more of the gaming machines may be desirable to be presented only to certain selected individuals, such as casino employees. Therefore, such authorized individuals may be given an unlocking device, such as an RFID transceiver, a wireless device, a physical key, a username and/or password, or other such permission based mechanism. An authorized individual could then use the unlocking device to activate display of an auxiliary video presentation on one or both of the video output signals at an acute viewing angle to the multi-output display 70. This could be done while a player at the gaming device continues to play the wagering game on the first video output signal of the display, such that the authorized individual and the player are each able to see different video presentations simultaneously (at different viewing angles) without interfering with one another. In this way, a casino technician or casino manager, for example, could view maintenance or game play statistics on a video output signal at an acute viewing angle, while the player continued play on a video output signal at a substantially orthogonal viewing angle. Moreover, other eligibility requirements could be utilized. For example, the alternate or additional output signals could be provided to only certain selected players, based upon membership status, betting levels, time on device, placement of a secondary or side wager, etc. Any of numerous eligibility requirements may be utilized so as to activate or deactivate the additional output signals from the display.

With embodiments of the gaming system 54 utilizing one or more mirrors 72*a,b*, such as those shown in FIGS. 3 and 4, the player is presented with multiple views of the output signals 74*a,b,c* from the same vantage point (substantially in front of, or orthogonal to, the display 70). In this way, the multi-output display 70 and mirrors 72 serve to create a multiple display or meta-display, which in this case has three "screens" or views. The first view 74*a* is seen directly from the display 70 as described herein, while the second and third views (the alternate or additional views) are seen reflected in the mirrors 72*a,b*. The various screens of the meta-display depict the various video presentations of the first, second, and third output signals 74*a,b,c*. These various video presentations may be utilized in a variety of ways. For example, each of the video presentations may depict a separate wagering game such that the meta-display allows a player to simultaneously view three wagering games. One of the alternate or additional views 74*b,c* may be utilized to present auxiliary information such as progressive jackpot information, pay tables, persistent state information, game history information, account information, etc. Moreover, meters which show credits, wager size, lines bet, etc.—which are traditionally placed on the main screen of wagering game—may be relocated to one of the alternate views 74*b,c*. In this way, the primary wagering game 60 may be resized so as to fill the primary view 74*a* and thus enlarged for easier viewing by the player.

In yet other embodiments, two or more of the output signals 74*a,b,c* may present a unified display of one or more portions of the wagering game. For example, a first portion of the reels 62 of the wagering game 60 may be presented on the main output signal 74*a* while a second portion of the reels are presented on an auxiliary output 74*b,c*. This way the reels 62 of the wagering game 60 may be stretched across all three viewing outputs 74*a,b,c* to create a unified display across three of the "screens" of the meta-display. In other words, the three video output signals 74*a,b,c* may present a unified panoramic view. Such unified images across multiple screens are described in detail in U.S. Pat. Nos. 6,254,481 and 6,569,018 to Jaffe and assigned to WMS Gaming Inc., which are incorporated herein by reference in their entirety.

Moreover, it should be understood that the first, second, and third video presentations 74*a,b,c* may be customizable either by the operator of the gaming system 54, the player, or both. For example, the player may be provided with the option of customizing the information displayed on the auxiliary views 74*b,c* while the wagering game 60 is preset to be displayed on the primary view 74*a*. In other embodiments, the player may change the output signal 74 on which the wagering game 60 is displayed. Moreover, casino operators may customize what appears on what signal 74, and at which time, including advertisements, promotions, game history information, casino information, etc. The player may be given some, full, or no customization options at the discretion of the casino.

In some embodiments, such as those in FIGS. 5 and 6, the auxiliary views 74*b,c* may be used to project and display advertising information. For example, the second and third video output signals 74*b,c* may include attract screen displays, casino advertising, or other promotional media messages. As described herein, such presentations on the auxiliary views 74*b,c* would not interfere with the play of the wagering game 60 by a player in front of the display 70 viewing the first video output signal 74*a*. In this way, as patrons walk past one or more of the gaming systems 10, they will be exposed to a variety of advertising information at certain angles, while players at the gaming systems 10 remain undisturbed. Moreover, in such embodiments as seen in FIG. 5, the player may be given extra information by tilting his or her head to one side to a different viewing angle, so as to see a different output signal 74*b,c*. For example, the primary view 74*a* may display the wagering game 60 while the auxiliary views 74*b,c* provide hints, clues, or other information at various times. Gaming system 54 manufacturers may also use the auxiliary or additional views 74*b,c* to advertise products or services.

The auxiliary views 74*b,c* may also be utilized to limit the usually wider viewing angles of standard displays and thus aid in preventing cheating, collusion, or unwanted viewing of wagering games 60. For example, by displaying advertisements on the auxiliary views 74*b,c* and limited display of the wagering game 60 to the primary view 74*a*, other players standing to the left and right at acute viewing angles to the multi-output display 70 are prevented from seeing the wagering game 60. Thus, limited certain information to the primary view 74*a* allows it to be protected from unwanted viewing (for example from someone seated at a gaming system next to the player). Therefore, the multi-output display 70 may be used to prevent cheating or collusion in group or community games where traditional displays would allow neighboring players to view each others' wagering games 60.

A touch screen may overly the multi-output display 70 for receiving touch sensitive inputs from a player, as is described in relation to FIG. 1. For embodiments where multiple video output signals 74*a,b,c* are emitted, such as the embodiment in FIG. 5, the touch screen may be used to select from multiple sets of selectable items. For example, one set of selectable items may be depicted on the primary view 74*a* from the display 70, while second and third sets of selectable items are depicted on the auxiliary views 74*b,c*. Thus, by tilting his head to the left or the right to a sharper viewing angle, the player may change the visible selectable items from one group to another. However, the touch screen overlying the display 70 may be utilized to receive input selections from one, two, or all three of the displayed views 74*a,b,c*. In one version of such an embodiment, the selectable items on one view 74*a* are located in distinct areas of the touch screen as compared to selectable items in another view 74*b* so that a received input touching the touch screen selects only one item at a time. In yet another version, or alternate embodiment, two or more of the selectable items displayed in different views 74*a,b,c* of the display 70 lie in the same area underneath the touch screen such that one selection input into the touch screen activates selection of multiple selectable items (one or more from each displayed view 74*a,b,c*). Moreover, in embodiments utilizing one or more mirrors 72, one or more touch screens may overly the mirrors 72 so as to receive selection inputs thereon.

Although in some of the embodiments shown in the FIGURES, the alternative views 74*b,c* are projected at viewing angles to the left and right of the multi-output display 70, in other embodiments, the alternative views 74*b,c* may be projected above and below the display 70. For example, the display 70 in FIGS. 3-6 may be rotated ninety degrees about an axis orthogonal to the surface of the display 70. This would then create a configuration whereby the first video output signal would still be transmitted directly outward (orthogonally) from the display 70. However, the alternative views 74*b,c* would be transmitted at acute angles up and down (instead of left and right) from the display 70. In embodiments using mirrors 72*a,b*, the mirrors 72*a,b* could be repositioned above and below the display 70 so as to properly reflect the second and third video output signals 72*b,c*. In embodiments where the display 70 is substantially flush mounted to the housing 56 of the gaming system 54, the player would need to change his viewing angle up and down (rather than left and right) to see the auxiliary views 74*b,c*. Although in the embodiments shown the multi-output display 70 projects three video output signals 74*a,b,c*, greater or fewer output signals 74 may be emitted. In alternate embodiments, the display 70 may project a primary output signal 74*a* and only one auxiliary output signal 74*b*. In yet other embodiments, three or more auxiliary signals 74*b,c* may be emitted by the display 70, either directly toward the player, or redirected toward the player by one or more mirrors 72. Many various combinations are possible.

Moreover, although the multi-output display 70 is depicted as part of a free standing gaming device or system 54, it should be understood from the description herein that the display 70 may be utilized in a variety of ways, including handheld gaming devices 110, community displays, casino displays, or as secondary or tertiary displays in combination with one or more standard displays on a gaming device 10.

It should also be understood that the video output signals on the various views from the multi-output display may be projected in a number of fashions. For example, the images in the various views may be two dimensional. Alternatively, the images may be real-time 3D, or renderings of three-dimensional perspectives or views under the control of a virtual camera in a three-dimensional environment. Combinations of the two may also be used over the various views. Moreover, as explained herein, different views may offer different perspectives (or different positions of the virtual camera) of the same gaming environment. As seen in FIGS. 7 and 8, one view 274*a* presents one perspective of the gaming environment while a second view 274*b* presents a second perspective. In this way, a player tilting his head to achieve different viewing angles relative to the multi-output display 270 may jump from one virtual camera position to another, giving the illusion that the player, by physically changing position, has achieved a different perspective.

The gaming systems of the present invention utilizing multi-output displays offer a number of advantageous over traditional displays. The multi-output displays may be used to create a meta-display or multiple view display at a cost significantly less than using separate individual displays. Moreover, the meta-display created by the multi-output display may be used to present additional information to the player in a variety of customizable ways. Additionally, the various video output signals may be used to present different views or perspectives of a single gaming environment, allowing the multi-output display to serve as a tool to provide the player the feel of being inside of the gaming environment, and therefore, creating a more lifelike and entertaining gaming experience.

Each of these embodiments and obvious variations thereof is contemplated as falling within the spirit and scope of the claimed invention, which is set forth in the following claims.

What is claimed is:

1. A gaming system comprising:

a wager input device;

a housing;

a multi-output display supported by the housing, the multi-output display displaying a first video presentation viewable from a first position having a first viewing angle relative to the display, the multi-output display displaying a second video presentation viewable from a second position having a second viewing angle relative to the display, wherein the second video presentation is not viewable from the first position, wherein at least one of the first and second video presentations includes displaying a randomly selected outcome of a wagering game, and a controller operative to simultaneously generate the first and second video presentations on the multi-output display.

2. The gaming system of claim 1, wherein the multi-output display is a liquid crystal display.

3. The gaming system of claim 1, wherein the multi-output display is mounted on a front face of the housing.

4. The gaming system of claim 1, wherein the multi-output display comprises a plurality of multi-channel pixels.

5. The gaming system of claim 1, wherein the multi-output display is mounted within a recessed portion of the housing.

6. The gaming system of claim 5, wherein the recessed portion of the housing includes at least one mirror positioned at an obtuse angle relative to the multi-output display.

7. The gaming system of claim 6, wherein the second video presentation is reflected by the at least one mirror so as to be viewable from the first position.

8. A method of conducting a wagering game on a gaming system comprising at least one wagering game machine, the method comprising:

receiving a wager via a wager input device of the wagering game machine; and simultaneously displaying a first video presentation and a second video presentation on a multi-output display device operatively associated with the wagering game machine to the output a plurality of video presentation at different angles, the plurality of video presentations comprising a first video presentation viewable from a first position having a first viewing angle relative to the multi-output display device, the plurality of video presentations further comprising a second video presentation viewable from a second position having a second viewing angle relative to the multi-output display device, wherein the first video presentation is not viewable from the second angle, wherein the second video presentation is not viewable from the first angle, and wherein at least one of the first and second video presentations includes displaying a randomly selected outcome of a wagering game.

9. A computer readable storage medium encoded with instructions for directing a gaming system to perform the method of claim 8.

10. The method of claim 8, wherein the first video presentation is displayed within a first range of viewing angles relative to the multi-output display device, the first range including the first viewing angle.

11. The method of claim 10, wherein the second video presentation is displayed within a second range of viewing angles relative to the multi-output display device, the second range including the second viewing angle.

12. The method of claim 11, wherein the first range and the second range are distinct.

13. The method of claim 12, wherein none of the angles in the first range is in the second range, and none of the angles in the second range is in the first range.

14. The method of claim 11, wherein the first video presentation is not viewable from at least a portion of the second range of viewing angles.

15. The method of claim 14, wherein the first and second video presentations are real-time 3D presentations.

16. The method of claim 10, wherein the second video presentation is not viewable from at least a portion of the first range of viewing angles.

17. The method of claim 8, wherein the second video presentation is a different perspective of the first video presentation.

18. A gaming system comprising:

at least one wager input device;

a first multi-output display supported by a first gaming machine, the first multi-output display adapted to display a plurality of video presentations;

a second multi-output display supported by a second gaming machine, the second multi-output display adapted to display a plurality of video presentations;

a third multi-output display supported by a third gaming machine, the third multi-output display adapted to display a plurality of video presentations;

at least one controller operative to coordinate to a position associated with the first gaming machine, a first video presentation generated by the first multi-output display, a second video presentation generated by the second multi-output display, and a third video presentation generated by the third multi-output display.

19. The gaming system of claim 18, wherein the first gaming machine is positioned substantially in between the second and third gaming machines.

20. The gaming system of claim 18, wherein the first video presentation is emitted substantially orthogonal from the first display.

* * * * *